US005214887A

United States Patent [19]

Beert

[11] Patent Number: 5,214,887

[45] Date of Patent: Jun. 1, 1993

[54] OVERHEAD CONDENSATE DRAIN SYSTEM

[76] Inventor: Francis C. Beert, 7019 Logan Ave., N., Brooklyn Center, Minn. 55430

[21] Appl. No.: 654,724

[22] Filed: Feb. 13, 1991

[51] Int. Cl.[5] ..... E02D 19/00

[52] U.S. Cl. ..... 52/169.5; 52/169.14

[58] Field of Search ..... 52/169.5, 169.14, 302, 52/303

[56] References Cited

U.S. PATENT DOCUMENTS

| | | | |
|---|---|---|---|
| 3,138,124 | 6/1964 | Baier | 52/169.5 |
| 3,407,552 | 10/1968 | Cassidy | 52/169.14 |
| 4,074,684 | 2/1978 | Biesel | 52/169.5 |
| 4,290,252 | 9/1981 | Demirel et al. | 52/169.14 |
| 4,298,294 | 11/1981 | Zimmerman | 52/169.5 |
| 4,798,034 | 1/1989 | Jarnagin et al. | 52/169.5 |
| 4,949,626 | 8/1990 | Townsend et al. | 52/169.5 |

*Primary Examiner*—Richard E. Chilcot, Jr.
*Assistant Examiner*—Joanne C. Downs
*Attorney, Agent, or Firm*—Lawrence M. Nawrocki

[57] ABSTRACT

A siphon drain system for removing condensate from a central air conditioning unit to a floor drain includes an overhead siphon line which passes between the air conditioner and the drain. The siphon line includes a first siphon end passing into a source container that holds a quantity of the condensate. The siphon line includes a second discharge end that is longer than the siphon end. When the line is primed, condensate will drain through the second discharge end at the same rate as it passes into the siphon end. Use of an overhead siphon line does not obstruct the floor of the building in which the air conditioner and drain are located.

16 Claims, 2 Drawing Sheets

OVERHEAD CONDENSATE DRAIN SYSTEM

TECHNICAL FIELD

This invention relates to a drain system for draining condensate from a source of such condensate, e.g. a central air conditioner, to a drain located remotely from the source.

BACKGROUND OF THE INVENTION

Central air conditioning systems are known in which a central air conditioner is used to cool more than one room of a dwelling and typically all of the dwelling Such air conditioners include various components including an evaporator coil often installed in the plenum of the dwelling's forced air furnace. This arrangement uses the normal furnace air distribution ducts to carry the cooled air throughout the dwelling. Various other parts of the air conditioning system are located outside, e.g. the motor unit and condensing coil. Hoses interconnect the condensing and evaporator coils to carry the refrigerant between them.

Not all dwellings have forced air heating systems. Some houses have hot water or steam heat. Central air conditioning systems can still be installed in such structures, but they require a separate duct system and fan(s) for distributing the cooled air. The evaporator coil of the air conditioner is still mounted somewhere in this duct system. Again, the other components of the air conditioning system are located outside.

One byproduct of the operation of any air conditioner is water which condenses on the outside of the evaporator coil from the air in the dwelling, thus also dehumidifying the air. This condensate is formed in relatively large amounts when the air conditioner is working fairly constantly in hot and humid climates. Removal of the condensate is no problem for a window air conditioner that cools a single room and sits in a window. For such a window unit, the condensate simply collects in a bottom drain pan and drains away outside the building through a drain hole located exteriorly of the building.

Unfortunately, condensate removal is more of a problem for central air conditioning systems that sit in the interior of some portion of the house, typically in the basement where the furnace is located. Most basements are provided with at least one drain in the basement floor. If the evaporator coil of the air conditioner is located close to this drain, a simple drain hose leading from the condensate drain pan is used to drain the condensate away. This works adequately in these situations.

However, a close location of the evaporator coil to the drain is not always possible, especially since many central air conditioning systems are retrofitted onto existing furnaces that were not originally located with any through to draining away condensate. While drain hoses are still used leading from the evaporator coil to the drain, such hoses are now simply laid across the basement floor and may extend over quite a long distance. These hoses can be hazardous as people can trip over them and they are certainly not aesthetically pleasing. This is especially true if the basement area has been or is intended to be remodeled into living areas for the family.

SUMMARY OF THE INVENTION

Accordingly, it is an aspect of this invention to provide an improved drain system for a condensate source.

More particularly, the drain system is located in the interior of a building in an area of the building also provided with a drain. The drain is located in a floor of the building area. In addition, means is provided for siphoning the condensate from the source to the drain, the siphon means including a siphon line passing between the source and the drain above the level of the floor, preferably at or proximate the ceiling.

BRIEF DESCRIPTION OF THE DRAWINGS

The present invention will be described in more detail hereafter in the following Detailed Description of the Invention, when taken in conjunction with the following drawings, in which like reference numerals refer to like elements throughout.

DETAILED DESCRIPTION OF THE INVENTION

Figure 1:
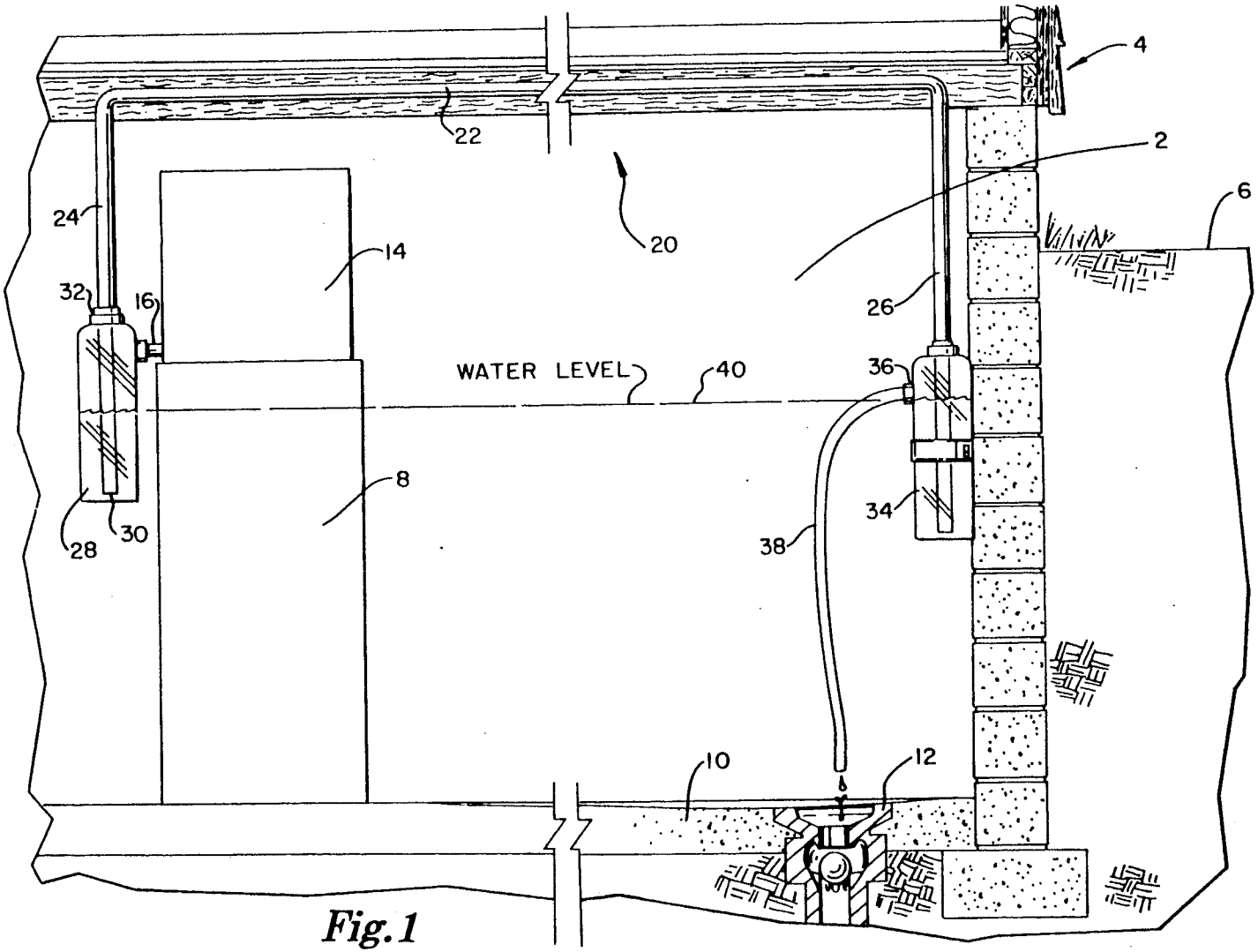
FIG. 1 is a side elevational view of a first embodiment of a condensate drain system according to the present invention.

Referring first to FIG. 1, the basement 2 of a typical dwelling 4 is shown located at least partially below ground level 6. A forced air furnace 8 is located on the basement floor 10 some distance from a drain 12. Furnace 8 includes a plenum 14 connected to a series of ducts (not shown) for delivering heated air throughout dwelling 4 during the winter. Plenum 14 also desirably encloses the evaporator coil (not shown) of a central air conditioning system of any known type to also deliver cooled air throughout dwelling 4 in the summer. Water which condenses on the evaporator coil during operation of the air conditioning system is collected and drained to the exterior of the plenum 14 through a drain pipe 16. This water will be referred to hereafter as the condensate.

The present invention relates to a system for draining the condensate from the source thereof, i.e. pipe 16, to a drain 12 located remotely from the source. This drain system is illustrated generally as 20 in FIG. 1. Drain system 20 is intended for situations where the condensate source and drain are separated for more than 1 or 2 feet, thus making use of a relatively short drain hose laid on the floor impractical. However, drain system 20 could be used even with drains located proximately to the source if desired, though most applications will be for remotely located drains.

In any event, drain system 20 includes an overhead drain line 22 that includes a siphon end 24 and a discharge end 26. Drain line 22 comprises any suitable fluid carrying tube, whether a flexible hose or rigid tubing sections joined together. Siphon end 24 extends down into a source container 28 connected to condensate drain pipe 16. Source container is mounted on the side of furnace 8 or an adjacent basement wall in any suitable fashion, e.g. simply by being connected to drain pipe 16 with the use of additional support brackets if necessary. The lowermost point of siphon end 24, indicated at 30 in FIG. 1, is located closely adjacent the bottom of source container 28. In addition, siphon end 24 passes into source container 28 through an apertured cap 32 to allow atmospheric pressure to press on the column of water maintained in source container 28.

Similarly, discharge end 26 of line 22 extends down into a disposal container 34 mounted in any suitable way to a basement wall 7 generally proximately to and above drain 12. The upper portion of disposal container 34 includes a drain port 36 connected to a downwardly extending drain line 38 that leads to drain 12. System 20 is designed to act as a continuous siphon. Thus, disposal container 34 must be lower than source container 28 and drain port 36 in disposal container must be higher than siphon point 30, both as shown in FIG. 1, to produce the desired siphon or suction effect.

Drain system 20 is initially primed by connecting drain line 38 to the household water system. The water system will pressurize the closed container 34 forcing water through lines 26, 22 and 24 and discharging water into source container 28. When container 28 is half-filled, the system is primed. Line 38 is then removed from the water supply and directed to drain 12. Thus, an initial filled state for system 20 can be established in which the water in both containers 28 and 24 will be maintained at the same level as noted by the water level line 40. This line 40 will be slightly below the level of drain port 36 in drain system 20 during steady state operation.

Thus, if the air conditioning system is now operating, condensate will be drained into source container 28 through drain pipe 16. As the water level rises in source container 28, it also will be continuously siphoned out into disposal container 34 through line 22 to maintain a balanced water level. As the water level in disposal container 34 rises, it will finally reach drain port 36 and be drained away to drain 12 through line 38. Thus, drain system 20 represents a closed, balance system that when filled and operating looks much like that shown in FIG. 1. As condensate collects in source container 28, a corresponding amount of condensate will also be discharged from disposal container 34 to maintain a balanced system.

Drain system 20 is advantageous in that it allows an interiorly located condensate source to be remotely located from a drain without having a floor mounted drain line. Overhead line 22 can be mounted in any appropriate fashion to the ceiling of the structure, such as passing between floor joints as shown in FIG. 1. Alternatively, line 22 could be affixed to a solid ceiling in any suitable manner, or even run above a suspended ceiling. In any of these overhead locations, line 22 is unobstrusively located out of the path of people and does not otherwise obstruct the basement area through which it passes.

While drain system 20 is effective for draining condensate away from its source to drain 12, it may become less effective over time if the flow rate or surface tension is insufficient to carry out the air bubbles that form in the line 22. As these air bubbles form, system 20 compensates by sustaining a fluid level in source container 28 that is higher than the original fluid level and higher than the level in disposal container 34. However, as air bubbles continue to accumulate, the fluid level in source container 28 rises higher still until source container 28 eventually overflows, which is obviously undesirable. This situation can be prevented by periodically restoring the original fluid balance, e.g. by flushing and refilling system 20 or by lowering disposal container 34 and/or by raising source container 28 sufficiently to cause a sharp increase in the pressure differential to get a high rate of fluid flow through line 22. This high flow rate or flushing action will flush air bubbles out of line 22. The need to manually do this on occasion can be one characteristic of the operation of system 20.

Figure 2:
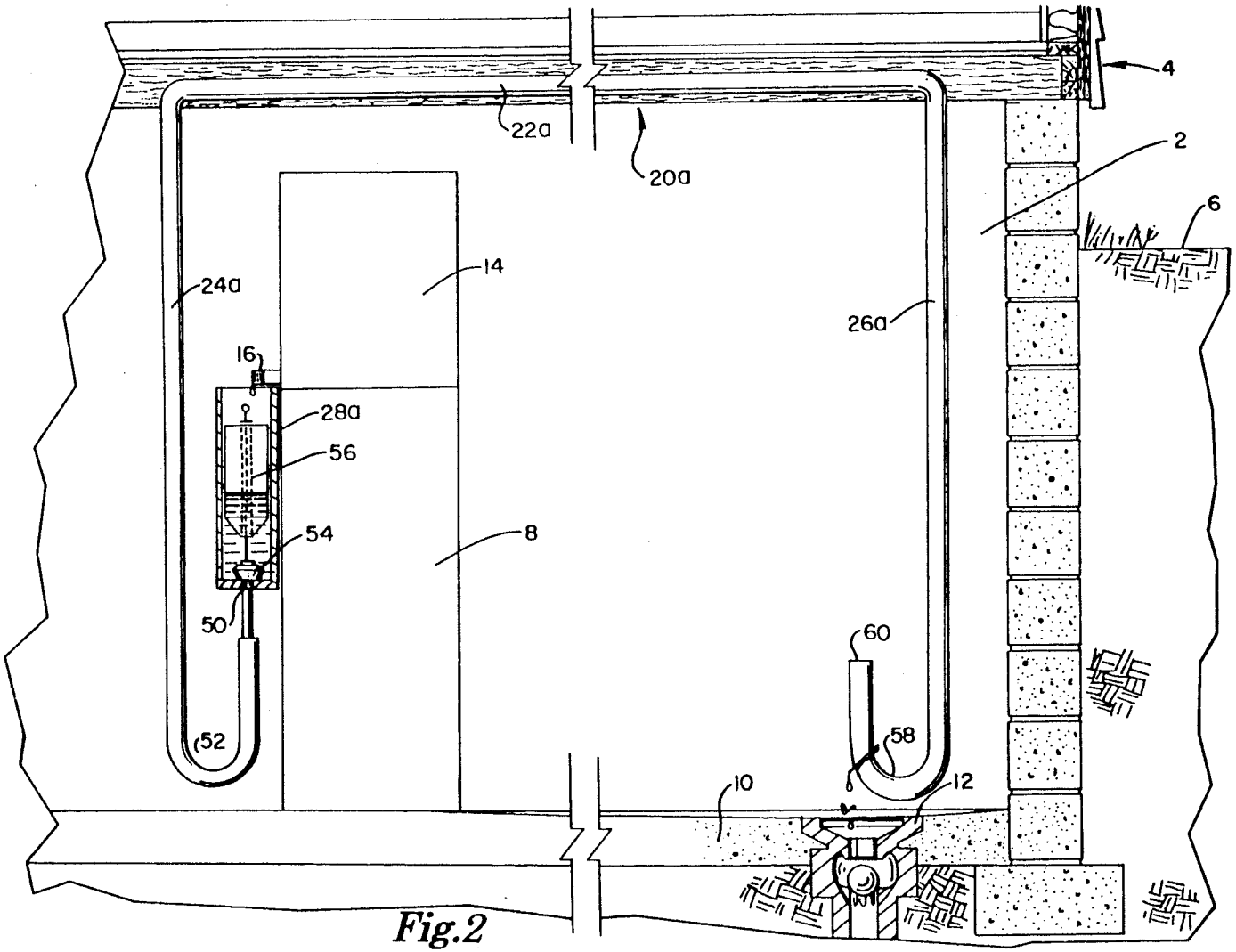
FIG. 2 is a side elevational view of a second embodiment of a condensate drain system according to the present invention.

A further embodiment of a drain system according to this invention is illustrated in FIG. 2 as **20*a*. The same reference numerals used to describe components of drain system 20 will be used to describe the same or similar components in drain system 20*a* with the addition of the letter "a", e.g. 20*a* versus 20. Drain system 20*a*** is designed to be self-flushing to automatically clear air bubbles from the system.

In drain system **20*a*, an overhead line 22*a* is again used having a siphon end 24*a* and a discharge end 26*a*. The source container 28*a* is changed to have a bottom outlet 50 to which siphon end 24*a* is connected after first passing through a U-shaped loop or trap 52. A plug or stopper 54 normally closes outlet 50. Stopper 54 is connected to a float 56 maintained in source container 28*a*. As the water level rises in container 28*a*, float 56 also rises until it eventually lifts stopper 54 from engagement with outlet 50. The amount of fluid drained from container 28*a* and the flow rate induced through line 22*a* before stopper 54 reseats on outlet 50 is desirably sufficient to flush out any air bubbles existing in line 22*a***.

In referring to FIG. 2, drain system **20*a* still works as a siphon system once line 22*a* is primed and filled with water. However, another difference between system 20*a* and system 20 is the absence of a disposal container on discharge end 26*a*. Instead, discharge end 26*a* simply extends downwardly to a point adjacent drain 12 and terminates there in a U-shaped trap 58 having an upper discharge opening 60. The U-shaped trap 52 on siphone end 24*a* extends below discharge opening 60 to ensure that the prime in the siphon system will be maintained if stopper 54 should for some reason fail to seat on outlet 50. In this event, drain system 20*a* will still function, albeit without the line flushing feature provided by stopper 54 and float 56**.

Numerous characteristics and advantages of the invention have been set forth in the foregoing description. It will be understood, of course, that this disclosure is, in many respects, only illustrative. Changes can be made in details, particularly in matters of shape, size, and arrangement of parts without exceeding the scope of the invention. The invention's scope is defined in the language in which the appended claims are expressed.

What is claimed is:

1. A drain system for a condensate source located in the interior of a building in an area of the building also provided with a drain, wherein the drain is located in a floor of the building area, which comprises means for siphoning the condensate from the source to the drain, the siphon means including a siphon line passing between the source and the drain above the level of the floor proximate a ceiling of the building area so as to not obstruct the building area, the siphon line further including a first siphon end extending downwardly therefrom to receive water from the condensate source and a second discharge end extending downwardly therefrom to discharge water to the drain, wherein the discharge end of the line is longer than the siphon end.

2. A drain system as recited in a claim 1, wherein the siphon line passes proximate to a ceiling of the building area so as to not obstruct the building area.

3. A drain system for a condensate source located in the interior of a building in an area of the building also provided with a drain, wherein the drain is located in a floor of the building area, which comprises means for siphoning the condensate from the source to the drain, the siphon means including as siphon line passing between the source and the drain above the level of the floor, the siphon line including a first siphon end extending downwardly therefrom to receive water from the condensate source and a second discharge end extending downwardly therefrom to discharge water to the drain, wherein the discharge end of the line is longer than the siphon end.

4. A drain system as recited in claim 3, further including a source container associated with the condensate source for receiving and storing a supply of condensate, the siphon end of the siphon line extending into the source container.

5. A drain system as recited in claim 4, further including a disposal container associated with the discharge end of the condensate source for receiving the discharge end of the line to allow the condensate to be stored therein prior to discharge.

6. A drain system as recited in claim 5, wherein the disposal container is of approximately the same size as the source container and is located at a lower vertical elevation than the source container in the building area.

7. A drain system as recited in claim 6, wherein the disposal container has a fluid outlet located above a lower end of the siphon end of the line, and further including a drain hose connected to the fluid outlet of the disposal container for draining condensate to the drain as it flows through the fluid outlet.

8. A drain system as recited in claim 3, further including means for storing a quantity of condensate and periodically releasing that condensate into the siphon end of the line to cause condensate to periodically flow through the line at a faster rate.

9. A drain system as recited in claim 8, wherein the storing means comprises a source container associated with the condensate source for storing a supply of condensate, and further including dispensing means in the source container for releasing condensate from the source container only when the level of condensate therein reaches a predetermined level.

10. A drain system as recited in claim 9, wherein the dispensing means comprises a stopper for sealing an outlet in the source container which outlet is connected to the siphon end of the line, and further including a float resting on the condensate level in the source container for lifting the stopper off the outlet.

11. A drain system as recited in claim 10, wherein the siphon end of the line includes a U-shaped trap connected to the source container.

12. A drain system as recited in claim 11, wherein the discharge end of the line extends down to a position proximate the drain, and further including a U-shaped trap at the lower end of the discharge end of the line.

13. A drain system as recited in claim 12, wherein an outlet of the U-shaped trap on the discharge end of the line is located at a vertical elevation above the lowermost point of the U-shaped trap on the siphon end of the line.

14. A drain system as recited in claim 3, wherein the condensate source is the evaporator coil of an air conditioning unit.

15. A drain system as recited in claim 14, wherein the evaporator coil is located in a plenum of a furnace.

16. A drain system for removing condensate from a drain pan of an evaporator coil on an air conditioner, wherein the air conditioner is located in an area of a dwelling in which a floor drain is provided on the same building level, which comprises:

(a) a source container operatively coupled to the drain pan for receiving condensate therefrom, the source container being fixed in the building area at a first vertical elevation;

(b) a disposal container supported in the building area at a second vertical elevation lower than the first vertical elevation, the disposal container having a fluid outlet therein located above the bottom of the disposal container;

(c) a drain hose connected to the fluid outlet of the disposal container and leading to a point proximate to the floor drain for draining condensate from the disposal container to the floor drain; and (d) a siphon line for siphoning a supply of condensate from the source container to the disposal container which comprises:

(i) an overhead run traversing the area between the source container and the disposal container, the run being located proximate to the ceiling of the building area;

(ii) a first siphon end extending downwardly from the overhead run into the source container, wherein the first siphon end has a lower end located at a vertical elevation lower than that of the fluid outlet in the disposal container; and (iii) a second discharge end extending downwardly from the overhead run into the disposal container for filling the container with condensate siphoned through the line, whereby the siphon line will maintain a balanced fluid level in the source and disposal containers and will siphon condensate through the line as condensate is added to the source container until it is discharged through the fluid outlet of the disposal container.

* * * * *